United States Patent [19]

Gerbus

[11] 4,418,634

[45] Dec. 6, 1983

[54] MARINE FLOAT

[76] Inventor: Leo H. Gerbus, 824 Kingfisher Dr., Cincinnati, Ohio 45202

[21] Appl. No.: 314,369

[22] Filed: Oct. 23, 1981

[51] Int. Cl.[3] ..... B63B 35/38

[52] U.S. Cl. ..... 114/263; 114/264

[58] Field of Search ..... 220/315, 307; 114/77 R, 114/77 A, 88, 352, 263, 264, 266, 267; 405/218, 219; 52/578, 588

[56] References Cited

U.S. PATENT DOCUMENTS

| | | | |
|---|---|---|---|
| 3,073,274 | 1/1963 | Lamb | 114/266 |
| 3,179,076 | 4/1965 | Sheffield | 114/263 |
| 3,323,479 | 6/1967 | Filak | 114/266 |
| 3,465,467 | 9/1969 | Allen | 220/315 |
| 3,760,754 | 9/1973 | Drummond | 114/266 |
| 3,811,141 | 5/1974 | Stoeberl | 114/88 |
| 3,897,741 | 8/1975 | Martini | 114/266 |
| 3,967,569 | 7/1976 | Shorter, Jr. | 114/263 |
| 4,041,716 | 8/1977 | Thompson | 114/266 |
| 4,043,287 | 8/1977 | Shorter, Jr. | 114/266 |
| 4,051,591 | 10/1977 | Thompson | 114/266 |
| 4,085,696 | 4/1978 | Shorter, Jr. | 114/263 |
| 4,163,503 | 8/1979 | McKinnon | 220/307 |

*Primary Examiner*—Trygve M. Blix
*Assistant Examiner*—Jesus D. Sotelo
*Attorney, Agent, or Firm*—Wood, Herron & Evans

[57] ABSTRACT

A marine float structure comprising a float unit, a deck unit, and a framework of connecting members to which the float and deck units are secured. Both the float and deck units are formed by rotationally molding a suitable high strength, durable polymeric material such as cross linked, high density polyethylene. The float and deck units are single piece, hollow, buoyant, rectangular box shaped housings differing in their dimensions only in that the depth of the deck unit is substantially less than that of the float unit. The top wall of both the float and deck units is flanged with respect to the end and side walls. The two units are secured to the connecting members sandwiched between the flanges by means extending through apertures in the flanges. The float unit is preferably filled with a polyurethane or similar foam material. A plurality of marine float structures are interconnected to form a marine floating dock.

5 Claims, 4 Drawing Figures

MARINE FLOAT

BACKGROUND OF THE INVENTION

1. Field of the Invention

The present invention relates to marine float structures. More particularly, the present invention relates to a marine float structure comprising a one piece float unit and a one piece deck unit secured together and to connecting members sandwiched between horizontal flanges on the two units. Still more particularly, the present invention relates to a marine floating dock comprising a plurality of interconnected marine float structures.

2. Description of the Prior Art

The prior art is replete with floating marine docks constructed in various shapes and designs from a wide variety of buoyant materials. For the most part, these docks have been lacking to one degree or another in structural strength and/or durability, i.e., resistance to the effects of the aqueous environment, especially sea water, in which they are used and to which they are exposed.

One form of marine floating dock that has proved to have both structural strength and durability is formed of a plurality of float units in which each float unit comprises a one piece buoyant, hollow, rectangular box shaped housing formed of high density polyethylene, a product noted for its strength and resistance to deterioration. Such a marine floating dock is disclosed and described in U.S. Pat. Nos. 4,041,716 and 4,051,591. As disclosed in these patents, each float unit of the marine dock is formed as a one piece housing and is secured to a wooden framework extending about the sides and ends of the housing by means of elongated tie rods extending into and through the width of the housing. To finish off the float unit, a deck is provided by laying wooden planking transversely across the top thereof and securing it to the wooden framework. To construct a marine floating dock, a plurality of the float units are juxtaposed and connected by appropriate means in the desired dock design. While this type of float unit has proved to be superior structurally and in durability to other forms of float units constructed of other materials, nevertheless, its current mode of use, at least as taught in the above patent specification, calls for connecting the housing to the framework in a manner which appears to jeopardize the intended sealed character of the housing, and further calls for decking material which lacks to some extent in the very qualities the material of the housing is intended to provide.

SUMMARY OF THE INVENTION

It is the principal object of this invention, therefore, to provide a marine float structure of high structural strength and durability. It is a further object of this invention to provide a marine float structure comprising a one piece, hollow float unit of a high strength, durable polymeric material connected to a deck unit of similar material and design by means of a common framework. It is a still further object of this invention to provide a means of securing the float unit and dock unit to a framework of connecting members without violating the sealed characteristic of the housing of the float unit. It is an additional object of this invention to provide a marine floating dock comprising a plurality of the marine floating structures hereof.

The marine floating structure according to the objects of this invention comprises a float unit, a deck unit, and framework of connecting members to which the float and deck units are secured. Each of the float and deck units is a single piece, hollow buoyant rectangular box shaped housing formed of a high strength, durable polymeric material, e.g., crosslinked, high density polyethylene. The length and width dimensions of the two units are essentially the same, but the depth of the deck unit is substantially less than that of the float unit. The top walls of the float and deck units are flanged with respect to the end and side walls by means of which the two units are secured to the framework connecting members extending the length and width of the two units. In constructing a floating marine dock using the marine floating structure, a plurality of the latter are juxtaposed side by side and/or end to end, and secured to each other by means of common longitudinal and transverse connecting members to form the desired dock design.

DESCRIPTION OF THE PREFERRED EMBODIMENT

Figure 3:
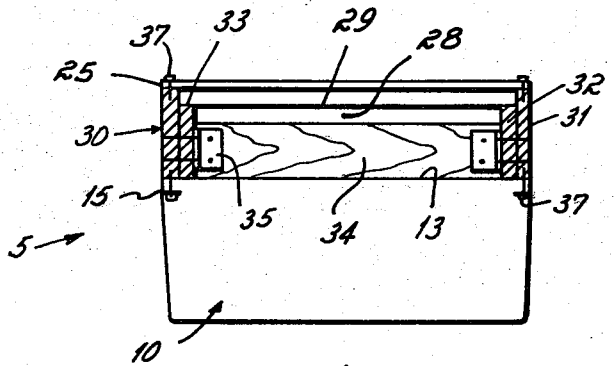
FIG. 3 is an end view of a marine floating structure taken on the line 3—3 of FIG. 1.
Figure 2:
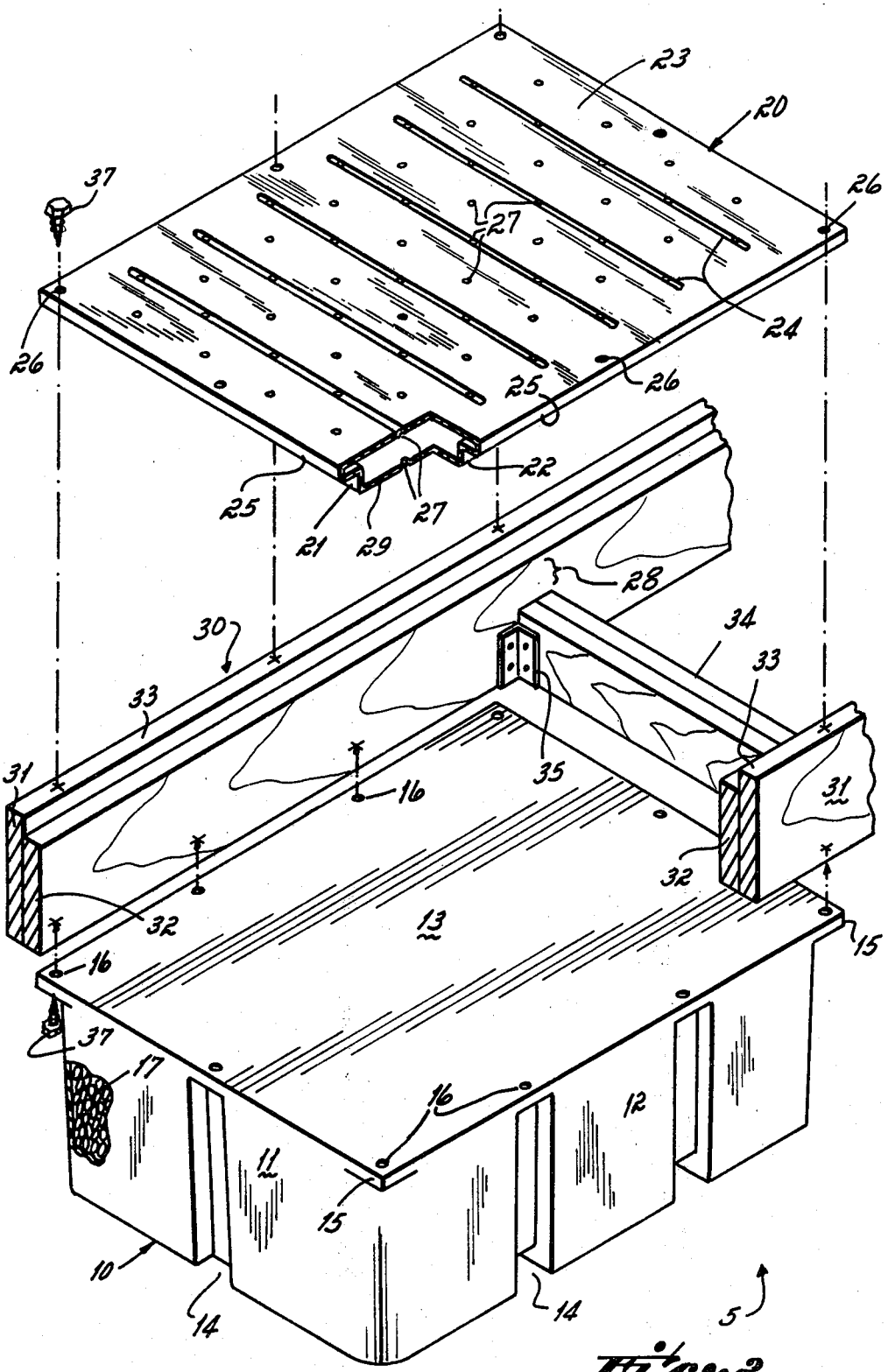
FIG. 2 is an exploded view of the marine floating structure.

Referring to the drawing, FIG. 2 shows an exploded view of the marine float structure 5 of this invention comprising a float unit 10, a deck unit 20, and a framework of connecting members 30. Float unit 10 comprises a one piece, hollow, buoyant rectangular box shaped housing produced from a high strength, durable polymeric material, e.g., a cross linked, high density polyethylene, by conventional rotational molding. The walls of float unit 10 are at least 0.125 in. in thickness, the end and side walls 11 and 12 preferably being integrally contoured as at 14 to provide additional strength. Top wall 13 of float unit 10 is flanged at a 90° angle at least at some points with respect to each of end and side wall 11 and 12, the flanges 15 being provided with apertures 16 adapted to receive means, such as conventional lag screws 37 (see FIGS. 2, 3 and 4), by which float unit 10 is secured to the framework of connecting members 30. Float unit 10 is provided with sealable means, not shown, by means of which any of various materials, such as foamed polyurethane 17, can be introduced into its hollow housing.

Deck unit 20 also comprises a one piece, hollow, buoyant rectangular box shaped housing produced from the same polymeric material and in the same manner as float unit 10. The width and length dimensions of deck unit 20 correspond essentially with those of float unit 10, but its depth is substantially less as can be readily seen from FIG. 2. Top wall 23 of deck unit 20 is flanged as at 25 at a 90° angle with respect to end and side walls 21 and 22, the flange 25 being provided with apertures 26 to receive means such as conventional lag screws 37, for securing deck unit 20 to the framework of connecting members 30. The walls of deck unit 20 are at least 3/16 in. in thickness, the top wall 23, and the bottom wall 29 if desired, being integrally contoured as at 24. Deck unit 20 is also provided with a plurality of passageways 27 in the top and bottom walls 23, 29 to connect the atmosphere above top wall 23 with the raceway 28, shown in FIG. 3 as located between bottom wall 29 of deck unit 20 and top wall 13 of float unit 10.

The framework of connecting members 30 is preferably constructed of wood, pressure treated in accordance with AWPB standards. The longitudinal framework comprising connecting members 31 and 32, preferably 2×8 and 2×10 double planking, defines a ledge 33 adapted to receive and secure longitudinal flange 25 of deck unit 20. The transverse framework to which float and deck units 10 and 20 are also secured, comprises connecting members 34, preferably 2×6 double planking. All connecting members of framework 30 are joined together by hot dipped galvanized hardware 35.

Figure 1:
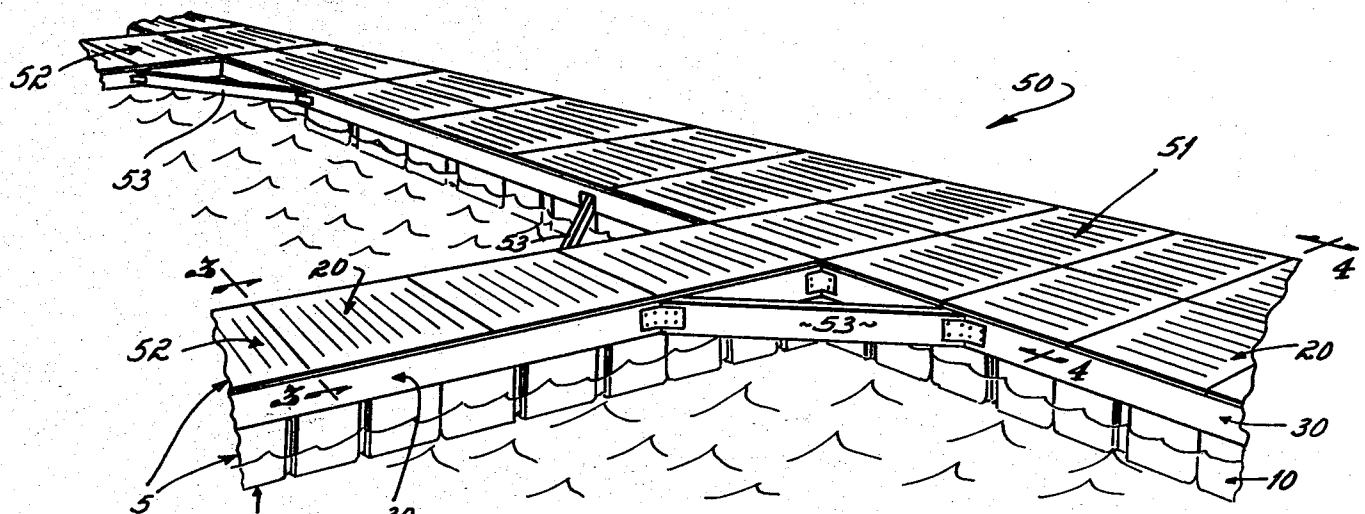
FIG. 1 is a perspective view of a marine floating dock constructed of a plurality of marine floating structures according to this invention.

Referring to FIG. 1, there is generally shown at 50 a marine floating dock constructed by joining together a number of marine float structures 5. The design of marine floating dock 50 is shown as having a headwalk 51 to which are joined several finger floats 52. It should be understood, however, that marine dock 50 may take varying forms simply by modifying the size, number and arrangement of marine float structure 5, the latter being subject to ready adaptation to any number of different dock designs.

Figure 4:
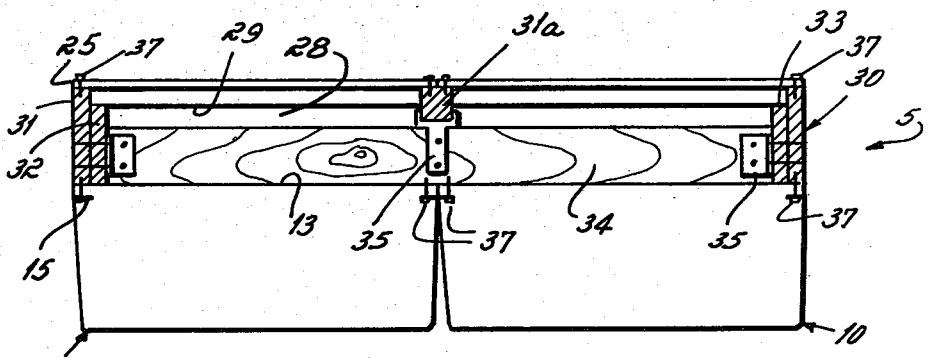
FIG. 4 is an end view of two marine floating structures secured side by side taken on the line 4—4 of FIG. 1.

The finger floats 52 are constructed by bringing together the desired number of marine float structures 5 in end relationship secured together by use of common longitudinal and transverse connecting members 31, 32 and 34 of framework 30. Headwalk 51 is similarly constructed but comprises, additionally, the bringing together of two marine float structures 5 in side by side relationship as shown in FIG. 4. Again, common longitudinal and transverse connecting members 31, 32 and 34 function to secure marine float structures 5 in both end to end and side by side relationship, the center longitudinal member 31 in this arrangement being appropriately modified, as at 31*a* in FIG. 4, to accept the side by side marine float structure 5. Suitable additional framing 53 is provided for securing finger floats 52 to headwalk 51, framing 53 having associated with it, if desired, decking, not shown, similar to deck unit 20. Transverse connecting members 34 are selected so as to provide, in conjunction with the bottom wall 29 of deck unit 20, a communicating passageway between raceways 28 of end to end adjacent float structures 5, thereby providing a protected continuous raceway extending the length of headwalk 51 and finger floats 52 in which utility lines can be carried. The surface of top wall 23 of deck unit 20 is textured to provide a non-slip surface providing an unusually attractive marine floating dock of exceptional strength and durability.

We claim:

1. A marine float structure comprising a one piece, molded hollow, buoyant, rectangular box-shaped float unit of high strength, durable polymeric material, said float unit having end, side, top and bottom walls, the top wall of which is flanged at a 90° angle at least at one point with respect to each side and end wall; a one piece, molded hollow, buoyant, rectangular box-shaped deck unit of high strength, durable polymeric material, said deck unit having end, side, top and bottom walls, the dimensions of which are essentially the same as those of the float unit except that the height of said side walls is substantially less than that of the float unit, the top wall of the deck unit being flanged at a 90° angle to the side and end walls thereof; a framework of connecting members sandwiched between the flanges of the float and deck units; and means connecting the float and deck units to the framework connecting members.

2. A marine float structure according to claim 1 in which the framework comprises connecting members that extend along the sides and end walls of the float unit.

3. A marine float structure according to claim 1 in which a raceway is provided between the top wall of the float unit and the bottom wall of the deck unit.

4. A marine float structure according to claim 1 in which the top wall of the deck unit is textured to provide a non-slip surface.

5. A marine floating dock comprising a plurality of interconnected marine float structures, said marine float structures according to claim 4.

* * * * *